US005681149A

United States Patent [19]

Weatherly

[11] Patent Number: 5,681,149

[45] Date of Patent: Oct. 28, 1997

[54] HYDRAULIC PUMP WITH SIDE DISCHARGE VALVE PLATE

[75] Inventor: Richard A. Weatherly, Jackson, Miss.

[73] Assignee: Trinova Corporation, Maumee, Ohio

[21] Appl. No.: 504,093

[22] Filed: Jul. 19, 1995

[51] Int. Cl.[6] ..... F04B 1/12; F04B 27/08

[52] U.S. Cl. ..... 417/269; 92/57

[58] Field of Search ..... 92/57; 417/269

[56] References Cited

U.S. PATENT DOCUMENTS

| | | | |
|---|---|---|---|
| 2,987,006 | 6/1961 | Bowers et al. . | |
| 3,011,453 | 12/1961 | Budzich . | |
| 3,079,870 | 3/1963 | Thoma . | |
| 3,170,297 | 2/1965 | Larson . | |
| 3,190,075 | 6/1965 | Ebert | 92/57 X |
| 3,295,457 | 1/1967 | Oram . | |
| 3,514,223 | 5/1970 | Hare . | |
| 3,587,404 | 6/1971 | Kratzenberg | 417/269 X |
| 3,693,508 | 9/1972 | Chondzinski . | |
| 3,975,990 | 8/1976 | Kraus | 92/57 |

*Primary Examiner*—Richard E. Gluck
*Attorney, Agent, or Firm*—Jones, Day, Reavis & Pogue

[57] ABSTRACT

A hydraulic pump is disclosed which uses a side-discharge valve plate. The present valve plate includes a valve plate body having front and back surfaces with a side defining the peripheral surface therebetween. First and second fluid passages are formed on at least one of said front and back surfaces for respectively defining a fluid inlet for supplying hydraulic fluid to a piston and a fluid outlet for receiving pressurized hydraulic fluid from a piston. At least one fluid access is formed in the side of the valve plate body, connecting with at least one of said fluid passages to define a fluid pathway therewith. The design of the present invention thereby permits a pump design have shorter axial length, permitting a smaller size pump which offers improved space considerations. Also, the present valve plate also has few contact surfaces, thereby reducing leakage and improving pump efficiency.

5 Claims, 6 Drawing Sheets

HYDRAULIC PUMP WITH SIDE DISCHARGE VALVE PLATE

BACKGROUND OF THE INVENTION

The present invention is directed to the field of hydraulic pumps, particularly those which include discrete valve plates. A hydraulic pump 10 according to the established design is shown in FIG. 1. The pump 10 includes a plurality of pistons 12 which are retracted to draw in hydraulic fluid from a supply source and are then compressed to discharge high-pressure hydraulic fluid. The pistons are concentrically retained within a cylinder block 14 which is rotationally displaced by a coupling shaft 16. The end of each piston 14 is capped by a piston shoe 18 which is securely retained in mechanical engagement with a yoke 20 by a retaining assembly 22. Each piston shoe 18 is in frictional contact with a shoe bearing plate 24.

The operation of the standard hydraulic pump 10 is additionally shown in FIG. 2. The yoke 20 is retained at an angle to the axis of rotation of the coupling shaft 16 and the cylinder block 14. (The yoke angle is typically about 17.5 degrees.) The yoke 20 does not rotate with the pistons but can be pivotally adjusted to vary the angle of inclination. Upon rotation of the cylinder block 14, the piston shoes 18 slide along the surface of the shoe bearing plate 24, making frictional contact. As the yoke 20 is inclined at an angle, the pistons 12 are alternately pulled out and pushed in by the rotation of the cylinder block 14. The cylinder block 14 includes a bore 26 for each piston 12. The cylinder block 14 substantially abuts a pump housing section 28 and fluidly communicates with an intake conduit 30 and a discharge conduit 32 through each bore 26. The intake conduit 30 supplies hydraulic fluid through each bore 26 to the pistons 12 and the discharge conduit 32 receives the pressurized hydraulic fluid discharged through each bore 26 from the pistons 12.

The pistons 12 are in fluid communication with the intake manifold 30 through a first kidney slot 34. As the piston 12 is pulled out during its intake stroke, the piston 12 draws in hydraulic fluid through the cylinder block bore 26 from the intake manifold 30 by way of the first kidney slot 34. Only a portion of the kidney slot 34 is covered by each bore 26. The remaining area of the kidney slot 34 is sealed off by the surface of the cylinder block 14 which abuts the surface of the pump housing section 28. The cylinder block 14 is rotated, and the piston 12 is pushed in during its discharge stroke, discharging its fluid into a second kidney slot 36 which is fluidly connected to the discharge manifold 32.

The volume of hydraulic fluid transferred by each piston 12 is determined by the cross-sectional piston area and the length of each stroke. The stroke length, in turn, is determined by the radial distance of the piston 12 from the axes of rotation and also the inclination of the yoke 20 to the axis. The pressure and flow of hydraulic fluid is determined by the volume transferred by each piston, the number of pistons and the rate of rotation of the coupling shaft 16. In a common arrangement, as many as nine pistons are typically employed. All the pistons 12 are at different stages of intake and discharge, thus insuring a smooth and steady level of hydraulic pressure. Most common hydraulic pumps supply around 3000 psi of pressure.

In a previous pump design, the kidney slots 34, 36 and the flow passages for the intake and discharge manifolds 30, 32 must be machined directly into the pump housing section 28. These machining operations are quite involved and thus expensive. Also, such machining necessitates the fabrication of multiple housing sections 28, 38, 40 in order to enclose the pump assembly. However, the additional housing sections 28, 38 must be separately fabricated, thus contributing to the expense of the pump. Also, since these housings 28, 38, 40 must be joined together, each interface is a potential leak site for hydraulic fluid, thus contributing to lost pump efficiency and increasing the incidence of maintenance for the pump.

A previous solution to the above-indicated problems is to fabricate a discrete valve plate 42, as shown in FIG. 3. As a separate component, the valve plate 42 is received on a seat surface 44 within the pump housing section 28. The kidney slots 34, 36 are machined directly through the valve plate 42, creating flow channels between the pistons 12 and the flow passages 46 of the pump housing section 28. The flow passages 46 are generally shaped to mate with the kidney slots 34, 36. Within the pump housing 28, the flow passages are shaped so as to transition from a kidney slot to a round passage having the proper port dimensions for the intake and discharge manifolds. The valve plate surface is a frictional surface and thus prone to wear. However, as a discrete component, the valve plate 42 may be made of a durable, wear-resistant material such as steel. This permits the housing 28 to be made of a light, easy-to-machine material such as aluminum. For these reasons, it has been advantageous to form hydraulic pumps using discrete valve plates.

In spite of their advantages, valve plates have several drawbacks. In common systems, there is inherently some leakage between the kidney slots 34, 36 and the flat surface of the cylinder block. While these surfaces are machined to a close tolerance, these surfaces nevertheless are in dynamic contact, and under hydraulic pressures, a certain amount of fluid will leak out between these surfaces. The discrete valve plate 42 effectively doubles the leak sites since leakage occurs on both the cylinder block side and the housing side of each kidney slot 34, 36. Also, the valve plate 42 necessarily adds axial length to the pump housing 28 since the housing must be sized to accommodate both the seat 44 and the flow passages 46 for the valve plate 42. For applications in which small pump size is at a premium, such additional axial length is undesirable.

BRIEF SUMMARY OF THE INVENTION

Therefore, in view of the above-noted disadvantages and drawbacks with previous hydraulic pump systems, there is therefore a need for a hydraulic pump using a valve plate which is less prone to leakage.

There is also a need for a hydraulic pump using a valve plate which provides a housing with shorter axial length.

There is also a need for a hydraulic pump using a valve plate which eliminates the need for a close tolerance seat surface on the housing for the valve plate.

There is also a need for a hydraulic pump using a valve plate which eliminates the high pressure kidney slot in the housing, thereby reducing failure due to high stress loads.

There is also a need for a hydraulic pump which is lighter in weight.

The above needs are satisfied by the present invention in which a hydraulic pump is disclosed using a side discharge valve plate. The present valve plate includes a valve plate body having front and back surfaces with a side defining the peripheral surface therebetween. First and second fluid passages are formed on at least one of said front and back surfaces for respectively defining a fluid inlet for supplying hydraulic fluid to a piston and a fluid outlet for receiving pressurized hydraulic fluid from a piston. At least one fluid access is formed in the side of the valve plate body, connecting with at least one of said fluid passages to define a fluid pathway therewith.

The above and other needs which are satisfied by the present invention will become apparent from consideration of the following detailed description of the invention as is particularly illustrated in the accompanying drawings.

DETAILED DESCRIPTION OF THE INVENTION

The present invention solves the problems associated with previous systems by providing a hydraulic pump incorporating a valve plate which provides a fluid access formed in the side of the valve plate body. FIGS. 4A through 4E show various views of the preferred embodiment of the present valve plate 50. The present valve plate includes a pair of fluid passages, preferably in the shape of kidney slots 52, 54, for exchanging hydraulic fluid between the pistons.

In the preferred embodiment illustrated in FIGS. 4A–4E, one kidney slot is machined to fully extend through the valve plate 50, between the front and back surfaces. In this way, hydraulic fluid is passed straight through the valve plate 50. The remaining kidney slot 54 is machined to a predetermined depth sufficient to intersect with a fluid access 56, formed in the side of the valve plate 50. The fluid access 56 flows the hydraulic fluid in a direction perpendicular to the kidney slots 52, 54. The void areas on the underside of the valve plate 50 are hollowed out to provide additional weight reduction.

Figure 1:
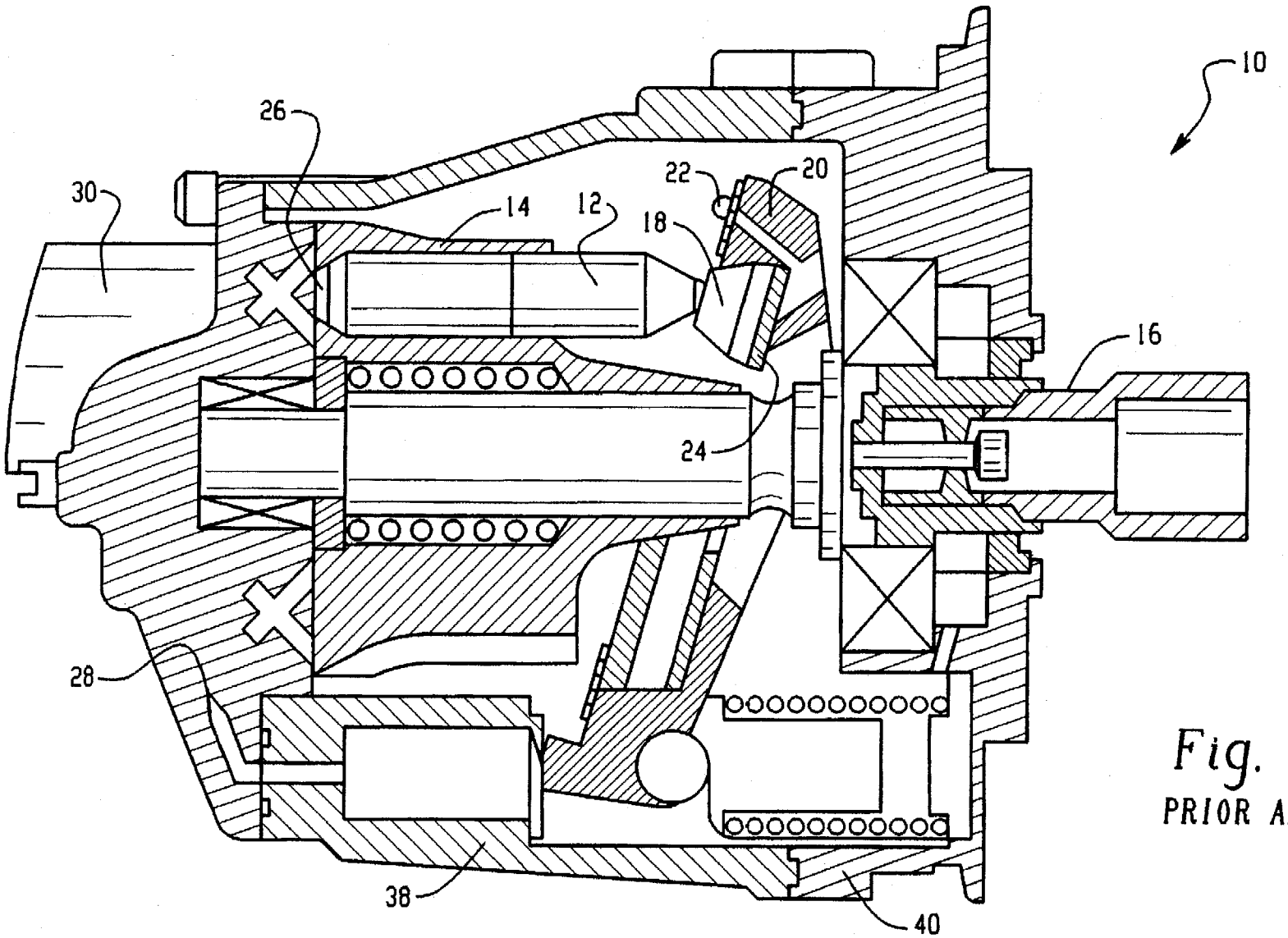
Fig. 1 PRIOR ART
FIG. 1 is a sectional view illustrating the configuration of a common hydraulic pump.
Figure 2:
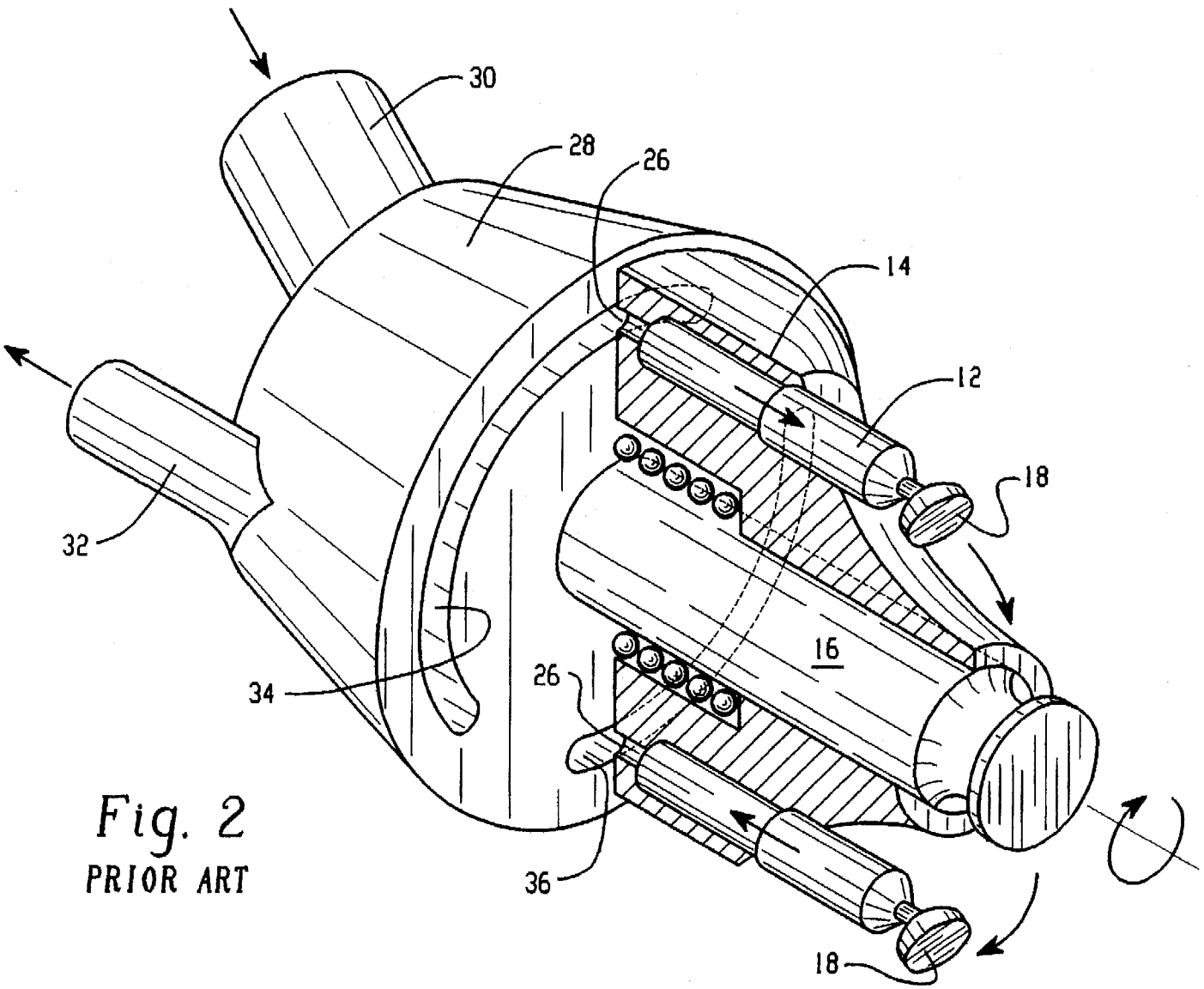
Fig. 2 PRIOR ART
FIG. 2 is a partial three-quarter views illustrating the piston operation of a common hydraulic pump.
Figure 3:
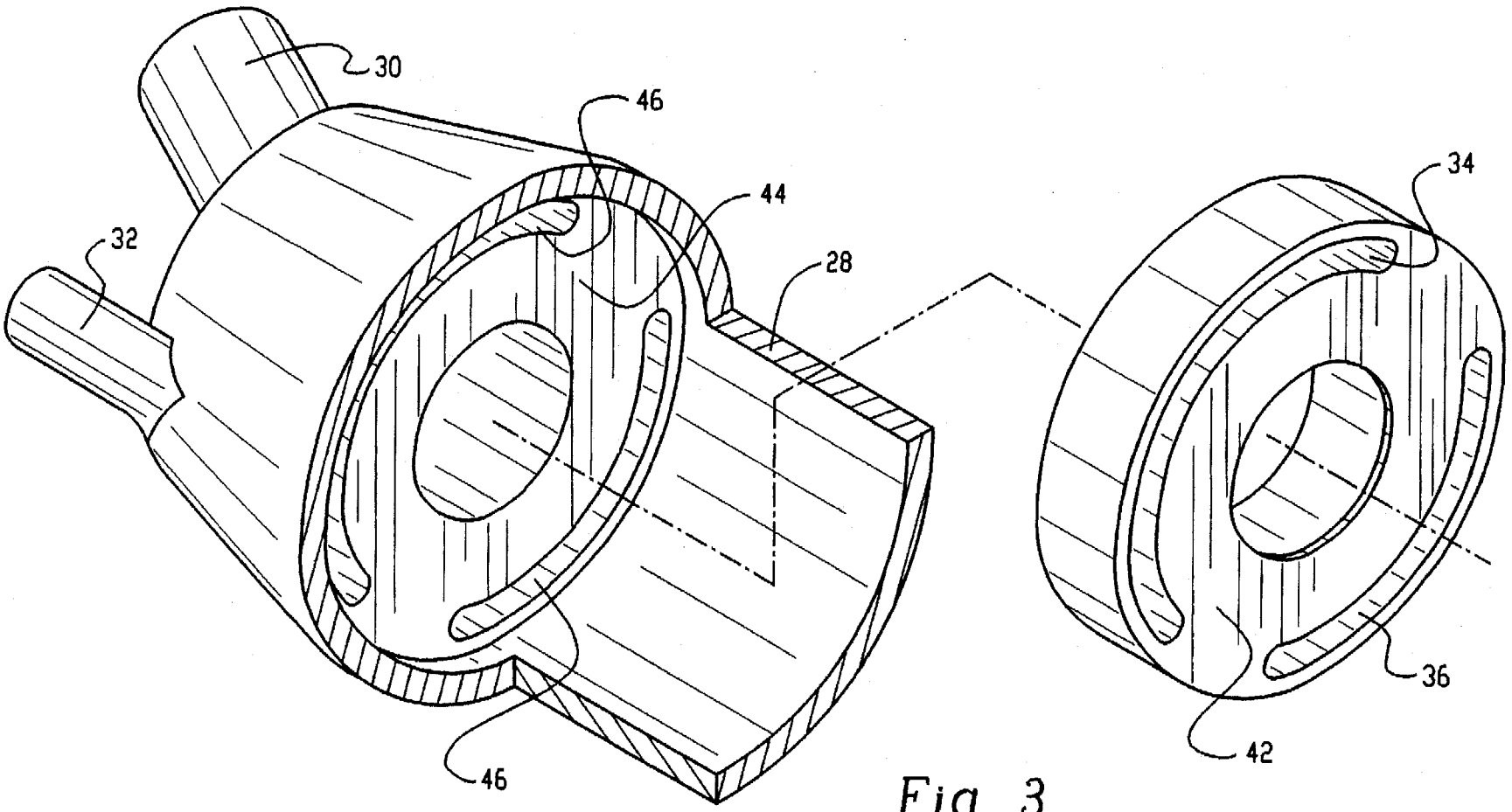
Fig. 3 PRIOR ART
FIG. 3 illustrates the pump housing with the valve plate as is used with previous hydraulic pump systems.
Figure 4A:
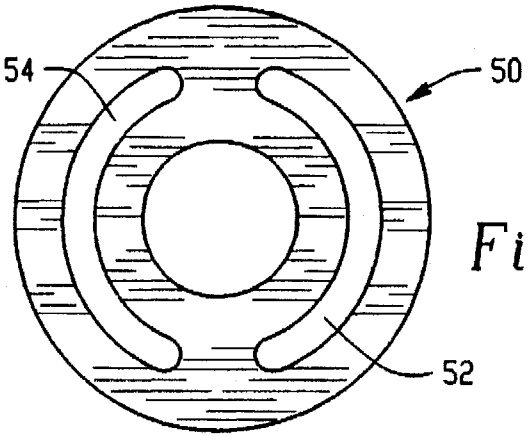
FIGS. 4A, 4B, 4C, 4D and 4E respectively depict top, side sectional, bottom, upper elevated sectional and lower elevated sectional views of the valve plate in conjunction with the preferred embodiment of the present invention.
Figure 4B:
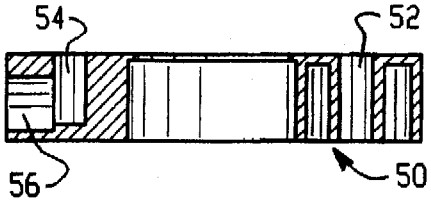
Figure 4C:
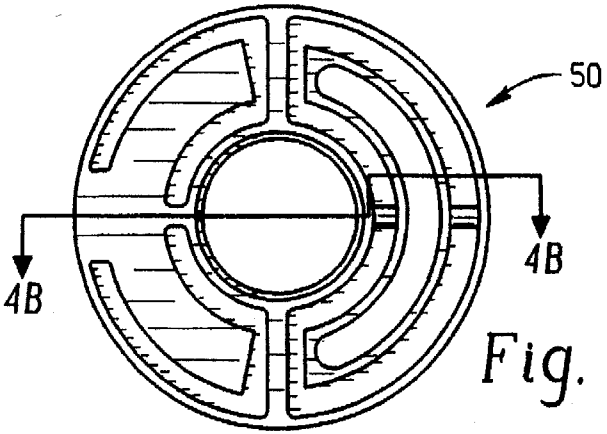
Figure 4D:
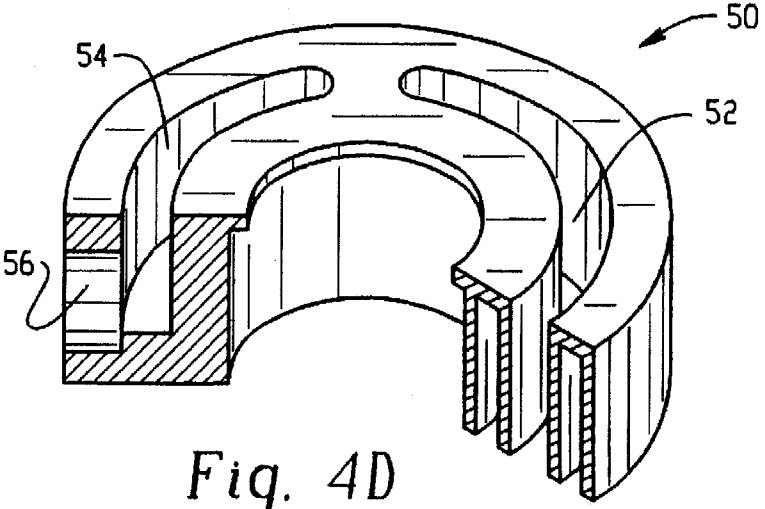
Figure 4E:
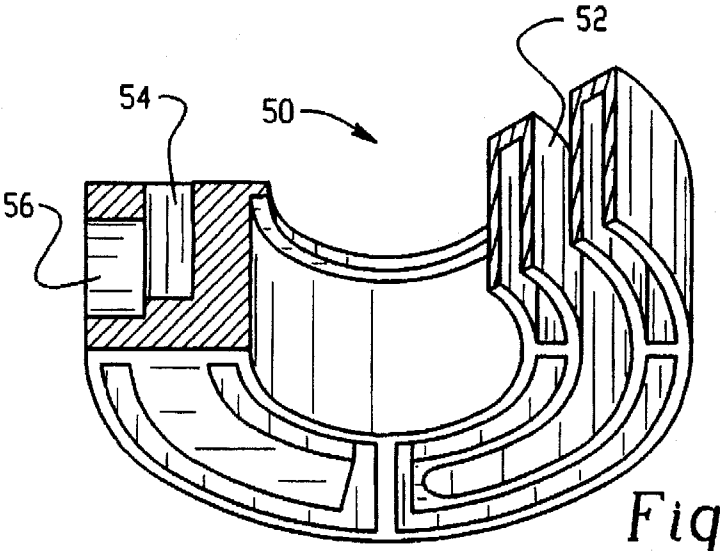
Figure 5:
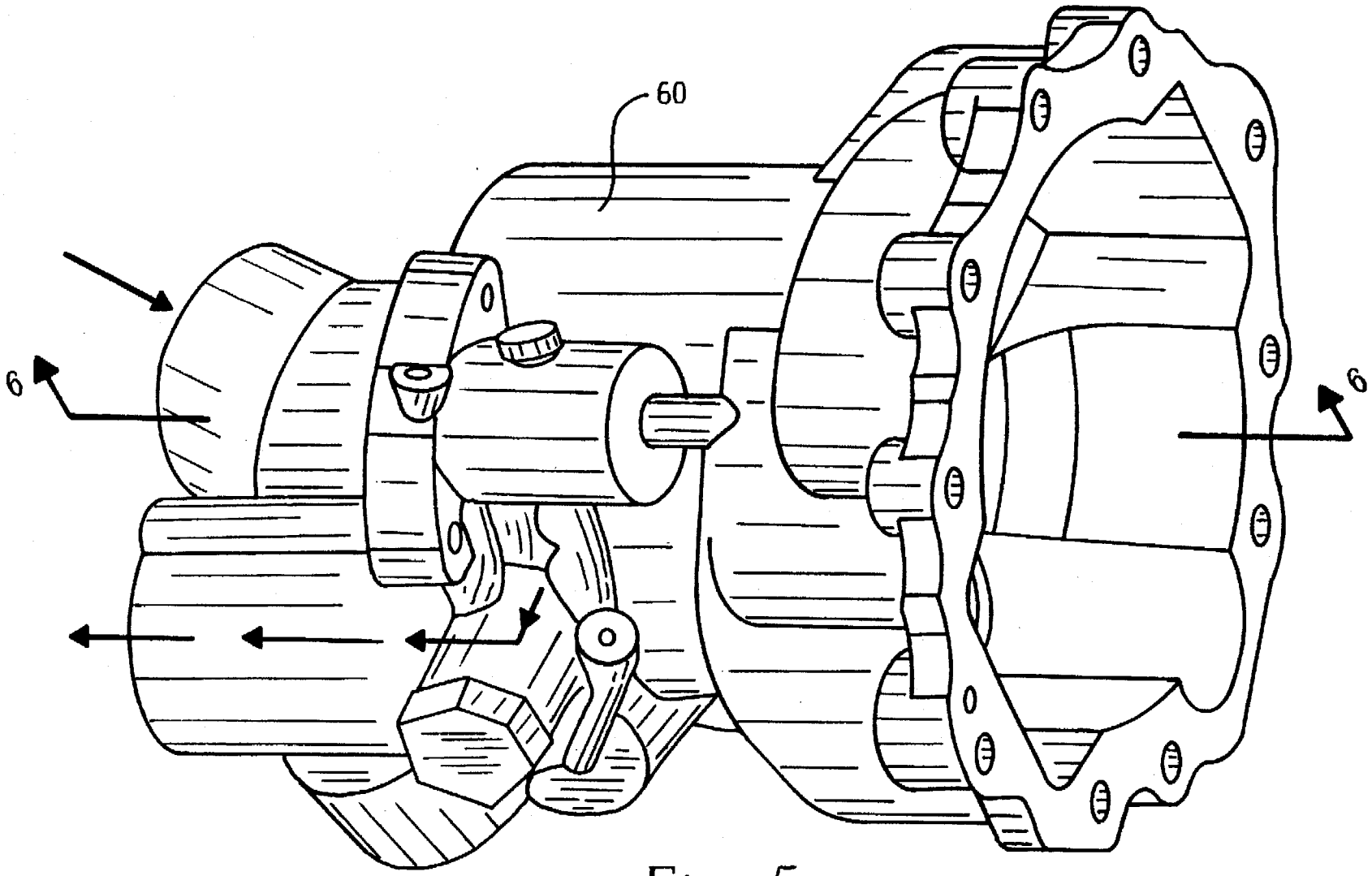
FIG. 5 is a plan view depicting the housing for the hydraulic pump of the present invention.
Figure 6:
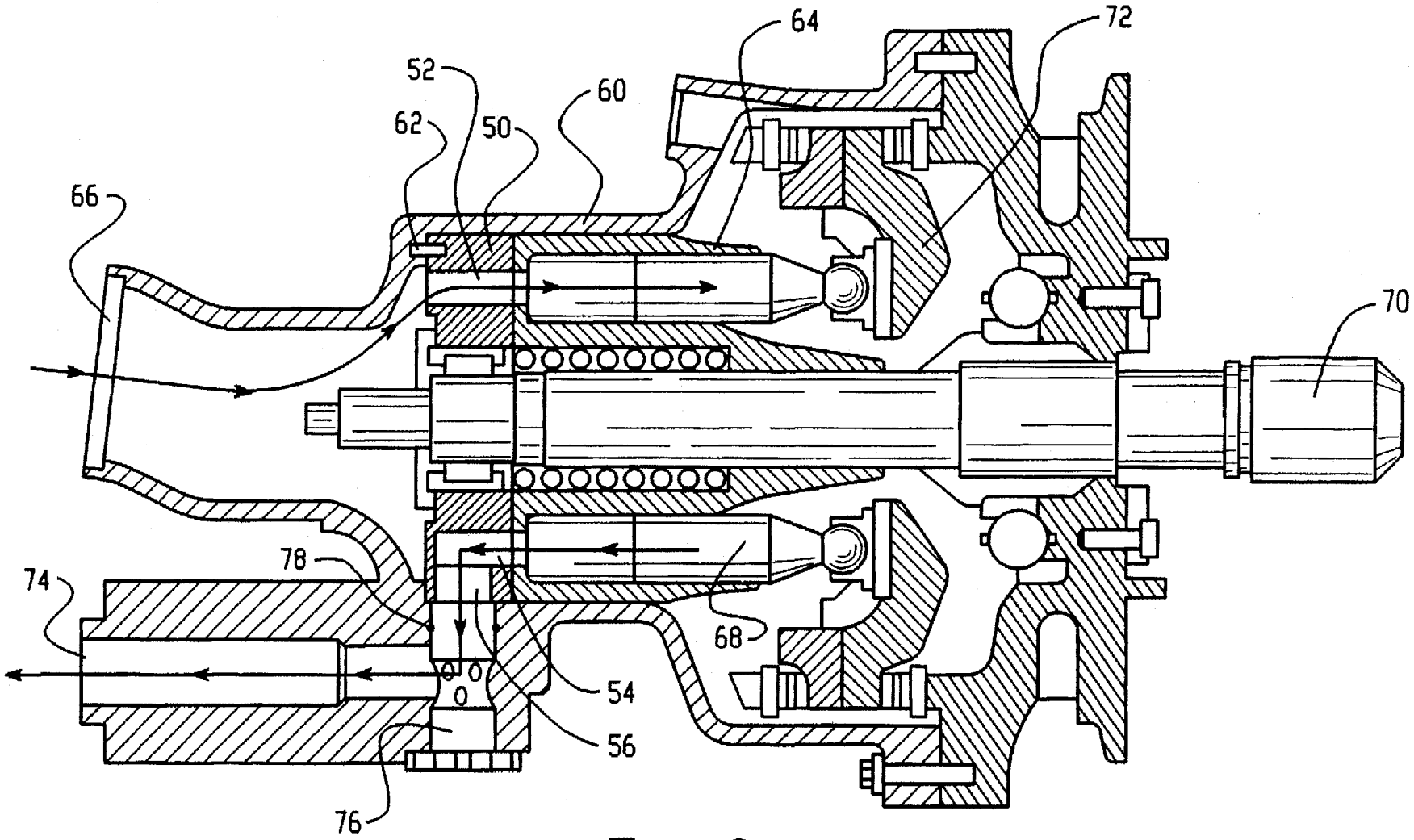
FIG. 6 is a view depicting a section of the hydraulic pump according to the present invention taken along the minor plane of bisection of the yoke.

The preferred embodiment of the present hydraulic pump is shown in FIGS. 5 and 6. A one-piece housing 60 is provided including a rim 62 which receives and seats the valve plate 50. The cylinder block 64 is in contact with the surface of the valve plate 50 in the manner common with such pumps. Hydraulic fluid is passed through the fully-extending kidney slot 52 from the inlet 66 to the pistons 68 during their intake stroke. As the cylinder block 64 is rotated by the coupling shaft 70, the pistons 68 are pulled out by the yoke 72 to draw in fluid through the inlet 66. On the discharge stroke, the pistons 68 are pushed in by the yoke 72 to discharge high-pressure hydraulic fluid into the kidney slot 54 which is fluidly connected to the perpendicular fluid access 56. The high-pressure fluid is then discharged through the discharge manifold 74, for delivery to the hydraulic system. The valve plate 50 is connected to the discharge manifold 74 through a transfer tube 76 which has an end that fits inside the fluid access 56. The transfer tube 76 is machined to a close tolerance so as to keep the leakage of high-pressure fluid at a minimum. Additionally, the transfer tube 76 can be machined to include a groove for accommodating an O-ring 78, which provides an additional fluid seal.

In the preferred embodiment shown, fluid is flowed through the inlet 66 and contacts the entire surface of the valve plate 50. Thus, this design eliminates both the need for a discrete seat surface for the valve plate 50 and the attendant machining to define the inlet and outlet fluid pathways. Thus, the present housing 60 may be cast in one piece with fewer machining steps than with previous hydraulic pumps. As the pressurized fluid is directed out the side of the valve plate 50, there is no longer any leakage at the exit side of the discharge kidney slot. Also, since there is no seat surface for the valve plate, the weight and axial length of the pump housing is reduced, thus reducing the overall size of the pump.

In an alternate embodiment of the present invention, the side fluid access 56 may also be used as on the inlet for supplying fluid to the pistons 68, while the fully-extended kidney slot 52 may be used to receive the discharged, pressurized fluid. In another alternate embodiment, two fluid accesses can be formed into the respective sides of the valve plate. Both kidney slots can be formed to a depth sufficient to intersect with each respective fluid access, and both the inlet and outlet are directed from the side. In this way, axial length can be reduced further, thus providing a further reduction in the overall size of the pump.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

What is claimed:

1. A hydraulic pump comprising:

a plurality of hydraulic pistons for receiving and discharging pressurized hydraulic fluid;

means for retaining and filling said pistons through a fluid inlet and discharging pressurized hydraulic fluid through a fluid outlet;

a valve plate for defining the respective fluid inlet and fluid outlet, said valve plate further comprising:

a valve plate body having front and back surfaces with a side defining the peripheral surface therebetween;

first and second fluid passages, formed on at least one of said front and back surfaces, for respectively defining said fluid inlet for supplying hydraulic fluid to the pistons and said fluid outlet for receiving pressurized hydraulic fluid from the pistons;

at least one fluid access, formed in the side of the valve plate body, and connecting with at least one of said fluid passages to define a fluid pathway therewith;

a pump housing having a side for receiving and enclosing the plurality of hydraulic pistons and the means for retaining and filling said pistons, and also for receiving and retaining said valve plate, said pump housing further comprising:

an intake manifold for supplying hydraulic fluid to the fluid inlet; and a discharge manifold for receiving pressurized hydraulic fluid from the fluid outlet, wherein the fluid access is a side discharge port and wherein the discharge manifold connects with said side discharge port to conduct the pressurized hydraulic fluid out the side of the pump housing.

2. The hydraulic pump of claim 1 further including a transfer tube for fluidly connecting the discharge manifold to the side discharge port, wherein the transfer tube is received within the side discharge port to substantially provide a hydraulic fluid seal.

3. The hydraulic pump of claim 2 wherein the transfer tube further comprises an O-ring to provide a further hydraulic fluid seal.

4. The hydraulic pump of claim 1 wherein one of the fluid passages is a kidney slot which extends between the front and back surfaces and wherein the other fluid passage extends to a depth sufficient to intersect with the fluid access.

5. The hydraulic pump of claim 1 wherein the valve plate body is disc-shaped and at least one fluid access extends radially inward from the side.

* * * * *